US008917031B2

(12) United States Patent
Xiao

(10) Patent No.: US 8,917,031 B2
(45) Date of Patent: Dec. 23, 2014

(54) BACKLIGHT PANEL CIRCUIT, BACK LIGHT PANEL AND LIGHT EMITTING DIODE DRIVER

(71) Applicant: Beijing BOE Optoelectronics Technology Co., Ltd., Beijing (CN)

(72) Inventor: Lijun Xiao, Beijing (CN)

(73) Assignee: Beijing Boe Optoelectronics Technology Co., Ltd., Beijing (CN)

( * ) Notice: Subject to any disclaimer, the term of this patent is extended or adjusted under 35 U.S.C. 154(b) by 85 days.

(21) Appl. No.: 13/805,130

(22) PCT Filed: Oct. 17, 2012

(86) PCT No.: PCT/CN2012/083099

§ 371 (c)(1),
(2), (4) Date: Dec. 18, 2012

(87) PCT Pub. No.: WO2013/056650

PCT Pub. Date: Apr. 25, 2013

(65) Prior Publication Data

US 2014/0070711 A1 Mar. 13, 2014

(30) Foreign Application Priority Data

Oct. 21, 2011 (CN) ..... 2011 1 0322787

(51) Int. Cl.
*H05B 37/02* (2006.01)
*H05B 33/08* (2006.01)
*G09G 3/34* (2006.01)

(52) U.S. Cl.
CPC ..... *H05B 33/0815* (2013.01); *H05B 33/0818* (2013.01); *H05B 33/0827* (2013.01); *G09G 3/342* (2013.01); *G09G 2320/064* (2013.01); *G09G 2330/02* (2013.01)
USPC ..... 315/294; 315/192; 315/247

(58) Field of Classification Search
USPC ..... 315/185 R, 186, 192, 247, 291, 294, 315/297, 299, 307, 308, 312, 360
See application file for complete search history.

(56) References Cited

U.S. PATENT DOCUMENTS 7,977,890 B2 * 7/2011 Kumagai ..... 315/247
8,334,662 B2 * 12/2012 Jin et al. ..... 315/299

(Continued)

FOREIGN PATENT DOCUMENTS

CN 101051444 A 10/2007
CN 101631409 A 1/2010

(Continued)

OTHER PUBLICATIONS

First Chinese Office Action dated Apr. 22, 2013; Appln. No. 201110322787.X.

(Continued)

*Primary Examiner* — Tung X Le
(74) *Attorney, Agent, or Firm* — Ladas & Parry LLP

(57) ABSTRACT

Backlight panel circuit, backlight panel and light emitting diode driver are disclosed. The backlight panel circuit comprises: a LED driver including a plurality of voltage followers and a PWM signal transmitter; LED chains; and a plurality of switch circuit units corresponding to the plurality of voltage follows in a one-to-one relationship. Each of the switch circuit units comprises a first switch circuit with a current input terminal being connected to an output terminal of a corresponding voltage follow, a current output terminal being connected to a first LED chain, and a signal input terminal being connected to a signal output terminal of the PWM signal transmitter; and a second switch circuit with a current input terminal being connected to the output terminal of the voltage follow, a current output terminal being connected to a second LED chain, and a signal input terminal being connected to the signal output terminal of the PWM signal transmitter. The PWM signal transmitter is adapted to transmit an on-off signal so as to control an alternate turn-on of the first and second switch circuits. The disclosed technical solutions decrease the cost of the liquid crystal display by reducing the number of voltage followers.

11 Claims, 2 Drawing Sheets

(56) References Cited

U.S. PATENT DOCUMENTS

| | | | | |
|---|---|---|---|---|
| 8,410,716 | B2 * | 4/2013 | Yao et al. | 315/291 |
| 2007/0229446 | A1 | 10/2007 | Oh et al. | |
| 2009/0261743 | A1 * | 10/2009 | Chen et al. | 315/192 |
| 2010/0283720 | A1 | 11/2010 | Segawa et al. | |
| 2011/0043115 | A1 | 2/2011 | Ge et al. | |
| 2011/0074839 | A1 * | 3/2011 | Liu et al. | 345/690 |
| 2011/0148323 | A1 * | 6/2011 | Yao et al. | 315/295 |

FOREIGN PATENT DOCUMENTS

| | | | |
|---|---|---|---|
| CN | 101841949 | A | 9/2010 |
| CN | 101971705 | A | 2/2011 |
| CN | 201765805 | U | 3/2011 |
| CN | 102629458 | A | 8/2012 |
| KR | 20110070065 | A | 6/2011 |

OTHER PUBLICATIONS

Second Chinese Office Action dated Dec. 11, 2013; Appln. No. 201110322787.X.

Third Chinese Office Action dated Feb. 27, 2014; Appln. No. 201110322787.X.

International Search Report mailed Jan. 31, 2013; PCT/CN2012/083099.

International Preliminary Report on Patentability dated Apr. 22, 2014, PCT/CN2012/083099.

* cited by examiner

BACKLIGHT PANEL CIRCUIT, BACK LIGHT PANEL AND LIGHT EMITTING DIODE DRIVER

BACKGROUND

The technique disclosed relates to backlight panel circuit, backlight panel and light emitting diode (LED) driver.

At present, Liquid Crystal Display (LCD) displays color images by operating the backlight panel which illuminates white light. The white light of the backlight panel is emitted from Light Emitting Diode (LED). As shown in FIG. 1, the backlight panel comprises a plurality of LED chains 12 each of which is consisted of LEDs 11, and LED driver 13 which causes the LED chains 12 to emit light. Each of the LED chains 12 comprises the same number of LEDs which are connected in series. The LED driver 13 supplies a voltage to each of the LED chains 12 so as to ensure the LEDs 11 on each of the LED chains 12 to emit normally.

The internal structure of the LED driver 13 in the prior art is shown in FIG. 2, which comprises a plurality of voltage followers (OP-AMP) 21, each OP-AMP 21 corresponding to a LED chain 12. The LED driver supplies a voltage to the LED chains through the output terminals of the OP-AMP 21. For example, a LED requires a voltage of 3V, and if there are ten LEDs of the same in one LED chain, a voltage of 30V is needed for the LED chain to emit normally. When the LED driver supplies voltage to the LED chains, the OP-AMPs function as voltage buffers and output the buffered voltages to the LED chains corresponding thereto in a one-to-one relationship. Assuming a liquid crystal panel of 20 inches, it needs one hundred of LEDs, and if one LED chain includes ten LEDs, there should be ten OP-AMPs in the LED driver, which will increase the cost of the liquid crystal panel.

In the prior art, a Pulse Width Modulation (PWM) signal transmitter transmits PWM signals to OP-AMPs in a predetermined PWM signal transmission cycle, which are used for controlling the OP-AMPs to output or not to output currents to the LED chains. The intensity of a light emitted by a LED chain depends on the average current intensity on the LED chain, which is a product of a current value of the current output from an OP-AMP to the LED chain and a duty ratio. The duty ratio is a ratio of an emission period of the LED chain to the PWM signal transmission cycle. For example, if the predetermined PWM signal transmission cycle is ten minutes and the actual emission period of the LED chain is two minutes, the duty ratio of the LED chain is 20%.

The present inventor found that there are a plurality of LED chains in a backlight panel and each chain needs to be connected to one OP-AMP. Thus, when there are too many LED chains in the backlight panel, the number of the OP-AMP being required is very large. In this case, the cost of the LED driver is increased much more, and since the LED driver is included in a liquid crystal display, the cost of the liquid crystal display also increases.

SUMMARY

A embodiment of the technical solutions disclosed herein provides a backlight panel circuit comprising: a Light Emitting Diode (LED) driver including a plurality of voltage followers OP-AMPs and a Pulse Width Modulation (PWM) signal transmitter; LED chains; and a plurality of switch circuit units corresponding to the plurality of OP-AMPs in a one-to-one relationship, each of the switch circuit units comprising:

a first switch circuit, a current input terminal of the first switch circuit being connected to an output terminal of a corresponding OP-AMP, a current output terminal of the first switch circuit being connected to a first LED chain, and a signal input terminal of the first switch circuit being connected to a signal output terminal of the PWM signal transmitter for receiving an on-off signal transmitted from the PWM signal transmitter which is used for controlling an alternate turn-on of the first switch circuit and the second switch circuits;

a second switch circuit, a current input terminal of the second switch circuit being connected to the output terminal of the corresponding OP-AMP, a current output terminal of the second switch circuit being connected to a second LED chain and a signal input terminal of the second switch circuit being connected to the signal output terminal of the PWM signal transmitter for receiving the on-off signal transmitted from the PWM signal transmitter;

wherein the PWM signal transmitter is adapted to transmit the on-off signal to the first and second switch circuits so as to control an alternate turn-on of the first switch circuit and the second switch circuit.

Another embodiment of the technical solutions disclosed herein provides a backlight panel comprising the backlight panel circuit described above.

Another embodiment of the technical solutions disclosed herein provides a Light Emitting Diode (LED) driver comprising: a plurality of voltage followers OP-AMPs; a Pulse Width Modulation (PWM) signal transmitter; and a plurality of switch circuit units corresponding to the plurality of OP-AMPs in a one-to-one relationship, each of the switch circuit units comprising:

a first switch circuit, a current input terminal of the first switch circuit being connected to an output terminal of a corresponding OP-AMP, a current output terminal of the first switch circuit being connected to a LED chain, and a signal input terminal of the first switch circuit being connected to a signal output terminal of the PWM signal transmitter for receiving an on-off signal transmitted from the PWM signal transmitter; and a second switch circuit, a current input terminal of the second switch circuit being connected to the output terminal of the corresponding OP-AMP, a current output terminal of the second switch circuit being connected to a LED chain and a signal input terminal of the second switch circuit being connected to the signal output terminal of the PWM signal transmitter for receiving the on-off signal transmitted from the PWM signal transmitter;

wherein the PWM signal transmitter is adapted to control an alternate turn-on of the first switch circuit and the second switch circuit.

Another embodiment of the technical solutions disclosed herein provides a backlight panel comprising the LED driver described above.

DETAILED DESCRIPTION OF THE PREFERRED EMBODIMENTS

Figure 1:
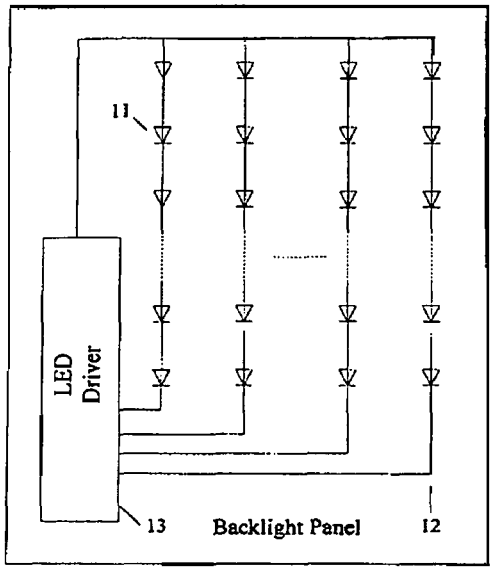
Prior Art Fig. 1
FIG. 1 is a schematic diagram of a structure of a prior backlight panel circuit.
Figure 2:
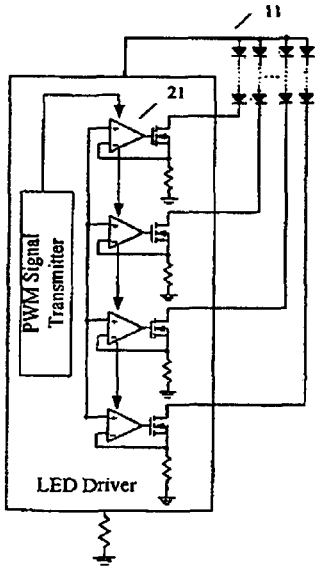
Prior Art Fig. 2
FIG. 2 is a schematic diagram of a circuit connecting a LED driver and LED chains in the prior art.
Figure 3:
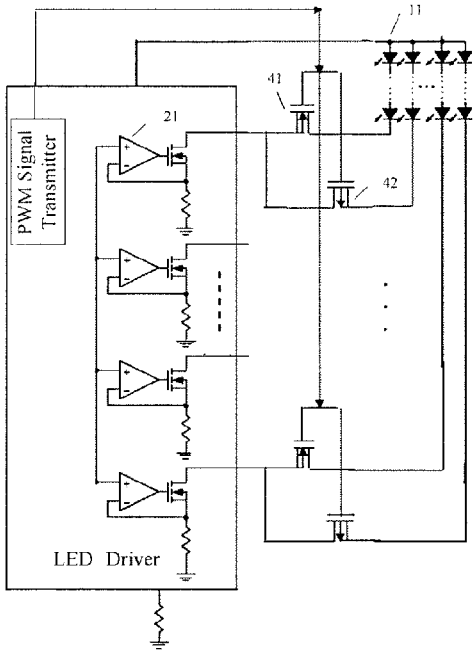
FIG. 3 is a schematic diagram of a structure of a backlight panel circuit provided by an embodiment of the disclosed technical solution.

With reference to FIG. 3, an embodiment of the disclosed technical solutions provides a backlight panel circuit and a Light Emitting Diode (LED) driver for solving the technical problem of reducing the cost of liquid crystal displays. The backlight panel circuit comprises a prior LED driver, LED chains 11 and a plurality of switch circuits the type of which is P-type switch circuit or N-type switch circuit. The number of the LEDs in each of the LED chains is the same.

The LED driver comprises a plurality of voltage followers OP-AMPs 21, a current output terminal of each OP-AMP 21 being connected in parallel to two different kinds of switch circuits, e.g., the first switch circuit 41 and the second switch circuit 42. The current output terminal of each OP-AMP 21 is connected to the current input terminals of the first and second switch circuits 41 and 42.

The first switch circuit 41 is connected to a first LED chain and the second switch circuit 42 is connected to a second LED chain.

The LED driver further comprises a PWM signal transmitter, the signal output terminal of which is connected to each of the switch circuits. Specifically, the signal output terminal of the PWM signal transmitter is connected to every signal input terminal of the first and second switch circuits 41 and 42 to which the current output terminals of the OP-AMPs 21 are connected, so as to transmit to the first and second switch circuits 41 and 42 an on-off signal for controlling an alternate turn-on of the first switch circuit and the second switch circuit. The on-off signal comprises a first on-off signal for turning on the first switch circuit 41 and turning off the second switch circuit 42, and a second on-off signal for turning on the second switch circuit 42 and turning off the first switch circuit 41. For example, when the PWM signal transmitter transmits the first on-off signal to the first and second switch circuits 41 and 42 at the same time, the first switch circuit 41 turns on and the second switch circuit 42 turns off, and then the OP-AMP provides a current to the first LED chain through the first switch circuit 41.

In particular, the PWM signal transmitter needs only to guarantee the period for transmitting the first on-off signal is equal to that for transmitting the second on-off signal. For example, the PWM signal transmission cycle is ten minutes and includes four periods, i.e. a first period, a second period, a third period and a fourth period. Among these periods, the first on-off signal is transmitted during the first and third periods and the second on-off signal is transmitted during the second and fourth periods. Therefore the sum of the first and third periods is equal to that of the second and fourth periods. There may be many other manners for combinations. With the above method, the duty ratio of each LED chain, which is the ratio of the emission period of the LED chain to the PWM signal transmission cycle, can be guaranteed to be 50%.

The PWM signal transmitter can transmit the on-off signal for turning on the first switch circuit or the second switch circuit in many ways. A preferable method is as follows:

During a first half of the predetermined PWM signal transmission cycle, the PWM signal transmitter transmits the first on-off signal which turns on the first switch circuit, and during a second half of the predetermined PWM signal transmission cycle, the PWM signal transmitter transmits the second on-off signal which turns on the second switch circuit; or alternatively, during the first half of the predetermined PWM signal transmission cycle, the PWM signal transmitter transmits the second on-off signal which turns on the second switch circuit, and during the second half of the predetermined PWM signal transmission cycle, the PWM signal transmitter transmits the first on-off signal which turns on the first switch circuit.

The on-off signal can be any signal that turns on the P-type switch circuit and turns off the N-type switch circuit, or turns off the P-type switch circuit and turns on the N-type switch circuit at the same time. Preferably, when the first on-off signal is a PWM high level signal, the second on-off signal is a PWM low level signal; or when the first on-off signal is a PWM low level signal, the second on-off signal is a PWM high signal;

When the first switch circuit receives an on-off signal that turns on the first switch circuit, the first switch circuit turns on, and then OP-AMP provides a current to the first LED chain; when the second switch circuit receives an on-off signal that turns on the second switch circuit, the second switch circuit turns on, and then OP-AMP provides a current to the second LED chain;

The current value of the current output from an OP-AMP to a LED chain is twice as that of the current which is required for the LED chain to emit normally, the reason for which is as follows:

Since an output terminal of one OP-AMP is connected to a P-type switch circuit and a N-type switch circuit, when the two switch circuits are connected to a same PWM signal transmitter, there is only one switch circuit is turned on, that is, only one LED chain emits light. And the light emitting intensity of a LED chain depends on the average current intensity of the LED chain which is equal to a product of the output current and the duty ratio, and the OP-AMP, for the technical solution of present disclosure, can be utilized more efficiently when the duty ratio is 50%. Therefore, it can be seen that the current value of the current output from the OP-AMP to the LED chain is twice as that of the current required for LED chains to emit normally. This is explained below in detail with reference to a particular embodiment.

An embodiment of the disclosed technical solution provides a backlight panel circuit, the circuit diagram of which is shown in FIG. 3. As shown in FIG. 3, it comprises a Pulse Width Modulation (PWM) signal transmitter, voltage followers OP-AMPs 21 and LED chains 11. The OP-AMPs 21 are used for outputting currents to the LED chains. The two switch circuits connected to the current output terminal of a same OP-AMP 21 are referred to as the first switch circuit 41 and the second switch circuit 42, respectively, wherein the first and second switch circuits 41 and 42 are different kinds of switches. For example, when the first switch circuit is a P-type switch circuit, the second switch circuit is an N-type switch circuit; or when the first switch circuit is an N-type switch circuit, the second switch circuit is a P-type switch circuit. The two switch circuits of different types are chosen so as to guarantee only one of the switch circuits is turned on and the other one is turned off when the two switch circuits receive the same PWM signal transmitted from the PWM signal transmitter at the same time. That is, only one of the LED chains connected to the first and second switch circuits is in an on state. In particular, the options are that:

If the P-type switch circuit turns on when receiving a PWM high level signal, the N-type switch circuit will turn on when receiving a PWM low level signal; if the P-type switch circuit turns on when receiving the PWM low level signal, the N-type switch circuit will turn on when receiving the PWM high level signal; if the P-type switch circuit turns on when receiving a positive voltage, the N-type switch circuit will turn on when receiving a negative voltage; and if the P-type switch circuit turns on when receiving a negative voltage, the N-type switch circuit will turn on when receiving a positive voltage. For the convenience of explanation, the first switch circuit is set as a P-type switch circuit and the second switch circuit is set as an N-type switch circuit in this embodiment, and the first switch circuit turns on state while the second switch circuit turns off when receiving the first on-off signal which is a PWM high level signal, and the second switch circuit turns on while the first switch circuit turns off when receiving the second on-off signal which is a PWM low level signal;

The PWM signal transmission cycle of the PWM signal transmitter is set according to the specific conditions in advance. During the first half of the PWM signal transmission cycle, the PWM high level signal is transmitted to all the switches in the backlight panel circuit, turning on the first switch circuit and turning off the second switch circuit, and the LED chain connected to the first switch circuit emits light; and during the second half of the PWM signal transmission cycle, the PWM low level signal is transmitted to all the switches, turning off the first switch circuit and turning on the second switch circuit, and the LED chain connected to the second switch circuit emits light. Thus, it can be guaranteed that the duty ratio of the same LED chain is 50%.

The brightness of a LED chain is primarily controlled by the average current which is a product of the current input to the LED chain and the duty ratio of this LED chain. Moreover, the average current required for a LED chain to emit normally is known, for example, a LED chain needs an average current of 60 mA, thus, the input current for the LED chain is 120 mA in present embodiment. This input current is the output current from the OP-AMP output terminal. Since this output current is a ratio of a voltage to an adjustable resistance and the voltage is constant, a suitable resistance value always can be found to control the output current to be at a required current value, and the LED chain can be guaranteed to emit normally when the duty ratio is 50%.

In the embodiment of the technical solution disclosed herein, the OP-AMPs 21 are set firstly to be in a state of outputting current.

Figure 4:
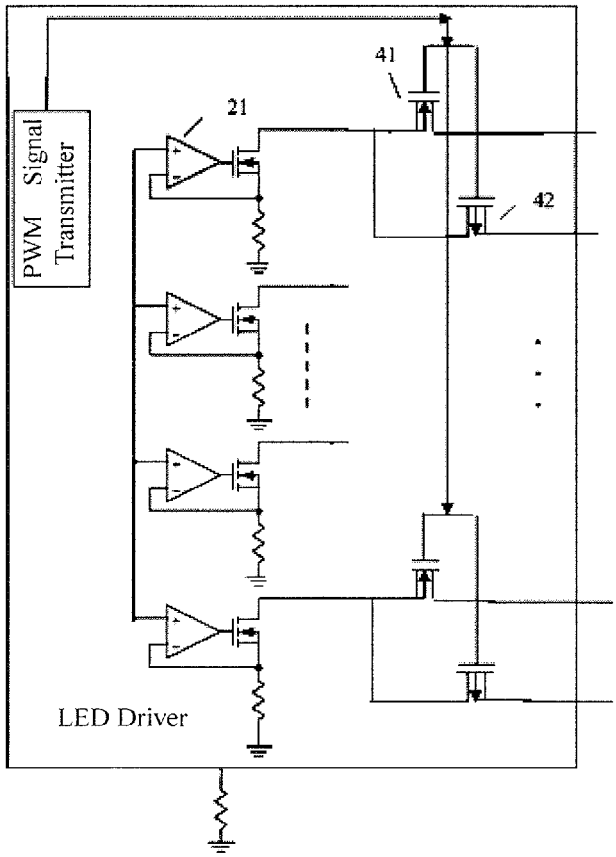
FIG. 4 is a schematic diagram of an internal circuit structure of a LED driver provided by an embodiment of the disclosed technical solution.

As shown in FIG. 4, an embodiment of the disclosed technical solution further provides a Light Emitting Diode (LED) driver comprising a plurality of voltage followers OP-AMPs 21, a Pulse Width Modulation (PWM) signal transmitter and a plurality of switch circuits corresponding to the plurality of OP-AMPs in an one-to-one relationship, wherein each of the switch circuit units includes:

a first switch circuit 41, wherein a current input terminal of the first switch circuit 41 is connected to an output terminal of a corresponding OP-AMP 21, a current output terminal of the first switch circuit 41 is connected to a LED chain, and a signal input terminal of the first switch circuit 41 is connected to a signal output terminal of the PWM signal transmitter for receiving an on-off signal transmitted from the PWM signal transmitter; a second switch circuit 42, wherein a current input terminal of the second switch circuit 42 is connected to the output terminal of the corresponding OP-AMP 21, a current output terminal of the second switch circuit 42 is connected to a LED chain and a signal input terminal of the second switch circuit 42 is connected to the signal output terminal of the PWM signal transmitter for receiving the on-off signal transmitted from the PWM signal transmitter.

The PWM signal transmitter is adapted to transmit the on-off signal to the first and second switch circuits 41 and 42 so as to control an alternate turn-on of the first switch circuit 41 and the second switch circuit 42, whereby the current is provided to the LED chain connected to the first switch circuit 41 when the first switch circuit 41 turns on or the current is provided to the LED chain connected to the second switch circuit 42 when the second switch circuit 42 turns on;

The on-off signal comprises a first on-off signal that turns on the first switch circuit 41 and turns off the second switch circuit 42, and a second on-off signal that turns on the second switch circuit 42 and turns off the first switch circuit 41;

When the first on-off signal is a PWM high level signal, the second on-off signal is a PWM low level signal; or when the first on-off signal is the PWM low level signal, the second on-off signal is the PWM high level signal.

When the first switch circuit 41 is a P-type switch circuit, the second switch circuit 42 is an N-type switch circuit; or when the first switch circuit 41 is an N-type switch circuit, the second switch circuit 42 is a P-type switch circuit.

An embodiment of the disclosed technical solution further provides a backlight panel comprising the backlight panel circuit described in the above embodiment;

An embodiment of the disclosed technical solution further provides another backlight panel comprising the LED driver described in the above embodiment, and the current output terminals of the LED driver are connected to the LED chains.

In a summary, an embodiment according to the disclosed technical solution provides a backlight panel circuit, wherein an output terminal of a voltage follower OP-AMP is connected to two LED chains via two switch circuits, respectively. When the PWM signal transmitter transmits an on-off signal that turns on the first switch circuit, the OP-AMP outputs current to the first LED chain, and the second switch circuit is in an off state at this time; when the PWM signal transmitter transmits a second on-off signal that turns on the second switch circuit, the OP-AMP outputs current to the second LED chain, and the first switch circuit is in a off state at this time. Accordingly, one OP-AMP in the LED driver can supply currents to two LED chains. Thus it can be seen that the number of the OP-AMPs in a LED driver can be reduced by half, and since a LED driver is a necessary section in a liquid crystal display, the cost of the liquid crystal display can be decreased by reducing the number of the OP-AMPs. Furthermore, since the output terminal of one OP-AMP is connected to both a P-type switch circuit and an N-type switch circuit, when the two switch circuits are connected to a same PWM signal, only one of the switch circuits is in an on state, that is, only one of the LED chains emits light. The light intensity of the LED chain is determined by the average current intensity of the LED chain which is equal to a product of the output current and the duty ratio. In the present technical solution, the OP-AMP can be utilized more efficiently when the duty ratio is 50%. Accordingly, the current value of the current output from the OP-AMP to the LED chain is twice as that of the current required for the LED chain to emit normally. Since the output current is a ratio of a voltage to an adjustable resistance and the voltage is constant, a suitable resistance value always can be found to control the output current to be at a required current value. Therefore the LED chains can be guaranteed to emit light normally when the duty ratio is 50%.

Those skilled in the art should understand that the embodiments of present invention can be implemented as methods, systems or computer program products. Therefore, the present invention can take the form of totally hardware embodiments, totally software embodiments, or combinations of software and hardware embodiments. Furthermore, the present invention can take the form of computer program products implemented on one or more computer usable storage medium (including, but not limited to magnetic disc storage, CD-ROM, optical memory or the like) containing computer usable program codes therein.

The present invention is described with reference to the flowcharts and/or block diagrams of the methods, devices (systems) and computer program products according to the embodiments thereof. It should be appreciated that each of the flows and/or blocks in the flowcharts and/or block diagrams and the combinations of the flows and/or blocks in the flowcharts and/or block diagrams can be realized by computer program instructions. These computer program instructions can be provided in the general purpose computers, dedicated computers, embedded processors or processors of other programmable data processing devices to generate a machine, so as to generate an apparatus for implementing the functions specified in one or more of the flows in the flow charts and/or in one of more of the blocks specified in the block diagrams by means of the instructions executed by the computers or processors of other programmable data processing devices.

These computer program instructions can also be stored in the computer readable storage which may direct the computers or other programmable data processing devices to operate in a particular manner, so that the instructions stored in the computer readable storage generate a product including instruction means which can realize the functions specified in one or more of the flows in the flow charts and/or specified in one or more of the blocks in the block diagrams.

These computer program instructions can also be loaded onto the computers or other programmable data processing devices, so that a series of operating steps is performed on the computers or other programmable data processing devices to provide a computer implemented process, thereby the instructions executed on the computers or other programmable data processing devices may provide steps for realizing the functions specified in one or more of the flows in the flow charts and/or specified in one or more of the blocks in the block diagrams.

Although the preferred embodiments of present invention have been described, those skilled in the art can make additional alternations and modifications to the embodiments once they learned the essential creative principles. Accordingly, the appended claims are intended to be interpreted as including the preferred embodiments and all the alternations and modifications that fall into the scope of present invention.

Those skilled in the art can obviously make various alternations and modifications to the present invention without departing from the spirit and scope thereof. In this regard, these alternations and modifications are intended to be included in the present invention if they are within the scope of the claims and the equivalent technique thereof.

What is claimed is:

1. A backlight panel circuit comprising:

a Light Emitting Diode (LED) driver including a plurality of voltage followers and a Pulse Width Modulation (PWM) signal transmitter;

LED chains; and a plurality of switch circuit units corresponding to the plurality of voltage follows in a one-to-one relationship, each of the switch circuit units comprising:

a first switch circuit, a current input terminal of the first switch circuit being connected to an output terminal of a corresponding voltage follow, a current output terminal of the first switch circuit being connected to a first LED chain, and a signal input terminal of the first switch circuit being connected to a signal output terminal of the PWM signal transmitter for receiving an on-off signal transmitted from the PWM signal transmitter; and a second switch circuit, a current input terminal of the second switch circuit being connected to the output terminal of the corresponding voltage follow, a current output terminal of the second switch circuit being connected to a second LED chain, and a signal input terminal of the second switch circuit being connected to the signal output terminal of the PWM signal transmitter for receiving the on-off signal transmitted from the PWM signal transmitter;

wherein the PWM signal transmitter is adapted to transmit the on-off signal to the first and second switch circuits so as to control an alternate turn-on of the first switch circuit and the second switch circuit, wherein the first LED chain emits light when the first switch circuit turns on and the second LED chain emits light when the second switch circuit turns on.

2. The backlight panel circuit according to claim 1, wherein, during a first half of a predetermined PWM signal transmission cycle, the PWM signal transmitter transmits a on-off signal which turns on the first switch circuit; and during a second half of the predetermined PWM signal transmission cycle, the PWM signal transmitter transmits a on-off signal which turns on the second switch circuit; or during the first half of the predetermined PWM signal transmission cycle, the PWM signal transmitter transmits the on-off signal which turns on the second switch circuit; and during the second half of the predetermined PWM signal transmission cycle, the PWM signal transmitter transmits the on-off signal which turns on the first switch circuit.

3. The backlight panel circuit according to claim 1, wherein the on-off signal includes a first on-off signal which turns on the first switch circuit and turns off the second switch circuit, and a second on-off signal which turns on the second switch circuit and turns off the first switch circuit;

wherein when the first on-off signal is a PWM high level signal, the second on-off signal is a PWM low level signal; and when the first on-off signal is a PWM low level signal, the second on-off signal is a PWM high signal.

4. The backlight panel circuit according to claim 1, wherein a current value of a current output from the voltage follow to a LED chain is twice as that of a current required for the LED chain to emit normally.

5. The backlight panel circuit according to claim 1, wherein when the first switch circuit is a P-type switch circuit, the second switch circuit is a N-type switch circuit; and when the first switch circuit is a N-type switch circuit, the second switch circuit is a P-type switch circuit.

6. A backlight panel comprising a backlight panel circuit, the backlight panel circuit comprising:

a Light Emitting Diode (LED) driver including a plurality of voltage followers and a Pulse Width Modulation (PWM) signal transmitter;

LED chains; and a plurality of switch circuit units corresponding to the plurality of voltage follows in a one-to-one relationship, each of the switch circuit units comprising:

a first switch circuit, a current input terminal of the first switch circuit being connected to an output terminal of a corresponding voltage follow, a current output terminal of the first switch circuit being connected to a first LED chain, and a signal input terminal of the first switch circuit being connected to a signal output terminal of the PWM signal transmitter for receiving an on-off signal transmitted from the PWM signal transmitter; and a second switch circuit, a current input terminal of the second switch circuit being connected to the output terminal of the corresponding voltage follow, a current output terminal of the second switch circuit being connected to a second LED chain, and a signal input terminal of the second switch circuit being connected to the signal output terminal of the PWM signal transmitter for receiving the on-off signal transmitted from the PWM signal transmitter;

wherein the PWM signal transmitter is adapted to transmit the on-off signal to the first and second switch circuits so as to control an alternate turn-on of the first switch circuit and the second switch circuit, wherein the first LED chain emits light when the first switch circuit turns on and the second LED chain emits light when the second switch circuit turns on.

7. A Light Emitting Diode (LED) driver comprising:

a plurality of voltage followers;

a Pulse Width Modulation (PWM) signal transmitter; and a plurality of switch circuit units corresponding to the plurality of voltage follows in a one-to-one relationship, each of the switch circuit units comprising:

a first switch circuit, a current input terminal of the first switch circuit being connected to an output terminal of a corresponding voltage follow, a current output terminal of the first switch circuit being connected to a LED chain, and a signal input terminal of the first switch circuit being connected to a signal output terminal of the PWM signal transmitter for receiving an on-off signal transmitted from the PWM signal transmitter; and a second switch circuit, a current input terminal of the second switch circuit being connected to the output terminal of the corresponding voltage follow, a current output terminal of the second switch circuit being connected to a LED chain, and a signal input terminal of the second switch circuit being connected to the signal output terminal of the PWM signal transmitter for receiving the on-off signal transmitted from the PWM signal transmitter;

wherein the PWM signal transmitter is adapted to transmit the on-off signal to the first and second switch circuits so as to control an alternate turn-on of the first switch circuit and the second switch circuit.

8. The LED driver according to claim 7, wherein:

during a first half of a predetermined PWM signal transmission cycle, the PWM signal transmitter transmits a on-off signal which turns on the first switch circuit; and during a second half of the predetermined PWM signal transmission cycle, the PWM signal transmitter transmits a on-off signal which turns on the second switch circuit; or during the first half of the predetermined PWM signal transmission cycle, the PWM signal transmitter transmits the on-off signal which turns on the second switch circuit; and during the second half of the predetermined PWM signal transmission cycle, the PWM signal transmitter transmits the on-off signal which turns on the first switch circuit.

9. The LED driver according to claim 7, wherein the on-off signal includes a first on-off signal which turns on the first switch circuit and turns off the second switch circuit, and a second on-off signal which turns on the second switch circuit and turns off the first switch circuit;

wherein when the first on-off signal is a PWM high level signal, the second on-off signal is a PWM low level signal; and when the first on-off signal is a PWM low level signal, the second on-off signal is a PWM high signal.

10. The LED driver according to claim 7, wherein a current value of a current output from the voltage follow to a LED chain is twice as that of a current required for the LED chain to emit normally.

11. The LED driver according to claim 7, wherein when the first switch circuit is a P-type switch circuit, the second switch circuit is a N-type switch circuit; and when the first switch circuit is a N-type switch circuit, the second switch circuit is a P-type switch circuit.

* * * * *